US009164429B2

(12) United States Patent
Xu

(10) Patent No.: US 9,164,429 B2
(45) Date of Patent: Oct. 20, 2015

(54) DEVELOPING DEVICE CAPABLE OF RESTRAINING LEAKAGE OF DEVELOPING AGENT

(71) Applicant: Brother Kogyo Kabushiki Kaisha, Nagoya-shi, Aichi-ken (JP)

(72) Inventor: Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/316,838

(22) Filed: Jun. 27, 2014

(65) Prior Publication Data

US 2015/0003863 A1 Jan. 1, 2015

(30) Foreign Application Priority Data

Jun. 28, 2013 (JP) ..... 2013-137424

(51) Int. Cl.
*G03G 15/08* (2006.01)

(52) U.S. Cl.
CPC ..... *G03G 15/0881* (2013.01)

(58) Field of Classification Search
CPC ..... G03G 15/0817; G03G 15/0881; G03G 15/0898
USPC ..... 399/103
See application file for complete search history.

(56) References Cited

U.S. PATENT DOCUMENTS

| | | | | |
|---|---|---|---|---|
| 5,701,558 | A | 12/1997 | Kojima | |
| 7,630,666 | B2 * | 12/2009 | Nakaya et al. | 399/103 |
| 8,229,317 | B2 * | 7/2012 | Xu et al. | 399/105 |
| 8,620,177 | B2 * | 12/2013 | Carot | 399/103 |
| 8,712,296 | B2 | 4/2014 | Mori | |
| 8,855,526 | B2 * | 10/2014 | Ito et al. | 399/103 |
| 2011/0158708 | A1 | 6/2011 | Mori | |

FOREIGN PATENT DOCUMENTS

| | | | |
|---|---|---|---|
| JP | H07-146613 | A | 6/1995 |
| JP | 2009-244450 | A | 10/2009 |
| JP | 2011-150269 | A | 8/2011 |

* cited by examiner

*Primary Examiner* — William J Royer
(74) *Attorney, Agent, or Firm* — Banner & Witcoff, Ltd.

(57) ABSTRACT

A developing device includes a frame, a developing roller, and first and second seals. The frame has a seal adhesion surface and a seal placement portion. The first seal is provided between the frame and a peripheral surface at an end portion of the developing roller. The second seal is in contact with the peripheral surface and has an end region positioned between the first seal and the peripheral surface. The second seal has a first end portion and a second end portion. The first end portion is adhered to the seal adhesion surface and has an end part adhered onto the first seal. The second end portion is in contact with the peripheral surface of the developing roller. The first seal is compressed in the seal placement portion by the second seal to abut on a stepped portion of the seal placement portion.

8 Claims, 7 Drawing Sheets

DEVELOPING DEVICE CAPABLE OF RESTRAINING LEAKAGE OF DEVELOPING AGENT

CROSS REFERENCE TO RELATED APPLICATION

This application claims priority from Japanese Patent Application No. 2013-137424 filed Jun. 28, 2013, the entire content of which is incorporated herein by reference.

TECHNICAL FIELD

The present invention relates to a developing device to be assembled in an electrophotographic type image forming device, and more particularly, to such device having a seal member.

BACKGROUND

A developing cartridge to be assembled in an electrophotographic type image forming device is well known. The developing cartridge includes a cartridge frame for accommodating therein developing agent (toner), a developing roller rotatably supported to the cartridge frame, and a seal member for restraining leakage of toner out of the cartridge frame.

Japanese Patent Application Publication No. 2011-150269 discloses a developing cartridge provided with seal members including a pair of side seals each positioned between each axial end portion of a developing roller and a developing frame, and a lower film extending over a length of the developing roller and between the developing roller and the developing frame. Each axial end portion of the lower film is in contact with each side seal.

With this structure, each side seal is adapted to restrain toner from leaking through a gap between each axial end portion of the developing roller and the developing frame, and the lower film is adapted to restrain toner from leaking through a gap between the lengthwise portion of the developing roller and the developing frame.

SUMMARY

In order to meet with a recent demand of high speed image formation, several requirements must be fulfilled such as high speed rotation of the developing roller, prolonged service life of the developing cartridge, and microparticulation of toner for the purpose of low temperature image fixing. To this effect, toner leakage through a boundary between the lower film and the side seal and through the gap between each axial end portion of the developing roller and the developing frame must further be prevented.

In view of the foregoing, it is an object of the invention to provide a developing device capable of restraining toner leakage out of the developing frame.

In order to attain the above and other objects, the invention provides a developing device including a frame, a developing roller, a first seal, and a second seal. The frame may be configured to accommodate developing agent therein. The developing roller may be rotatable in a rotational direction about an axis defining an axial direction relative to the frame. The developing roller may have a peripheral surface and an end portion in the axial direction. The first seal may be provided between the frame and the peripheral surface at the end portion of the developing roller. The first seal may have an upstream end portion in the rotational direction. The second seal may extend in the axial direction and is in contact with the peripheral surface. The second seal may have an end region in the axial direction. The end region may be positioned between the first seal and the peripheral surface at the end portion of the developing roller. The frame may include a seal placement portion at which the first seal is positioned, and a seal adhesion surface to which the second seal is adhered. The seal placement portion may have a stepped portion connected to the seal adhesion surface and positioned farther from the developing roller than the seal adhesion surface to the developing roller in a direction perpendicular to the axial direction. The seal adhesion surface may include a first surface and a second surface. The first surface may be connected to the first seal in the axial direction and be positioned inward of the first seal in the axial direction. The second surface may be positioned adjacent to and upstream of the upstream end portion of the first seal. The second seal may have a first end portion and a second end portion. The first end portion may be adhered to the seal adhesion surface and may have an end part in the axial direction adhered onto the first seal. The second end portion may be positioned opposite to the first end portion in the rotational direction and in contact with the peripheral surface of the developing roller. The first seal may be compressed in the seal placement portion by the second seal to abut on the stepped portion.

DETAILED DESCRIPTION

1. Overall Structure of Developing Cartridge

Figure 1:
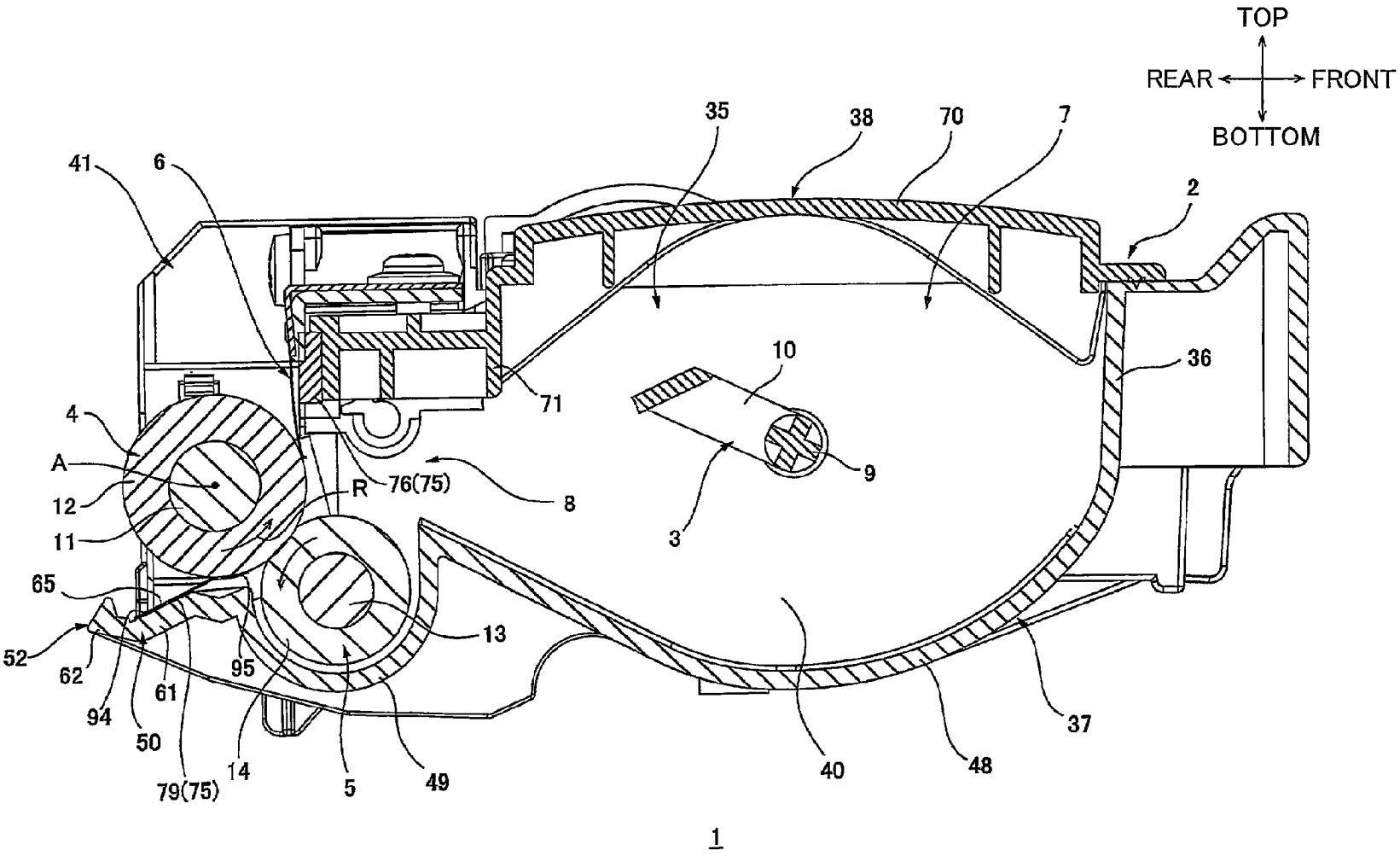
FIG. 1 is a cross-sectional view of a developing cartridge as an example of a developing device taken along a plane at a longitudinally center portion thereof according to one embodiment of the present invention.

As shown in FIG. 1, a developing cartridge 1 as an example of a developing device includes a cartridge frame 2, a developing roller 4, a supply roller 5 and a blade 6 for regulating a thickness of a toner layer.

In the following description, a side of the developing cartridge 1 at which the developing roller 4 is positioned will be referred to as "rear side", and a side opposite to the rear side will be referred to as "front side". Further, rightward/leftward direction will be given provided that the developing cartridge 1 is viewed from its front side. More specifically, each drawing contains arrows showing front side, rear side, upper side, lower side, left side and right side. For example, in FIG. 1, left side and right side of the drawing are the rear side and front side of the developing cartridge 1, respectively, and near side and back side of the drawing sheet are left side and right side of the developing cartridge 1, respectively. Here, leftward/rightward direction is an example of an axial direction, and upward/downward direction is an example of a direction perpendicular to the axial direction. Further, inward of leftward/rightward direction is a direction toward a widthwise center of the developing cartridge 1, and outward of leftward/rightward direction is a direction away from the widthwise center.

The cartridge frame 2 extends in the leftward/rightward direction and is box shaped having a rear end portion open in frontward/rearward direction. The cartridge frame 2 has an internal space for accommodating therein toner as an example of a developing agent.

The developing roller 4 is positioned at a rear end portion of the cartridge frame 2 and is rotatably supported thereto. The developing roller 4 has an upper rear portion exposed to an outside. The developing roller 4 has a shaft 11 and a supply roller body 12 coaxially disposed over the shaft 11.

The supply roller 5 is positioned frontward of and diagonally below the developing roller 4, and has an upper rear portion in pressure contact with a lower front portion of the developing roller 4. The supply roller 5 is rotatably supported to the cartridge frame 2. The supply roller 5 has a supply roller shaft 13 and a supply roller body 14 coaxially disposed over the supply roller shaft 13.

The blade 6 is positioned frontward of and diagonally above the developing roller 4, and extends in vertical direction. The blade 6 is supported to the cartridge frame 2 and has a lower end portion in contact with a front upper end portion of the developing roller 4.

2. Overall Structure of Printer

Figure 2:
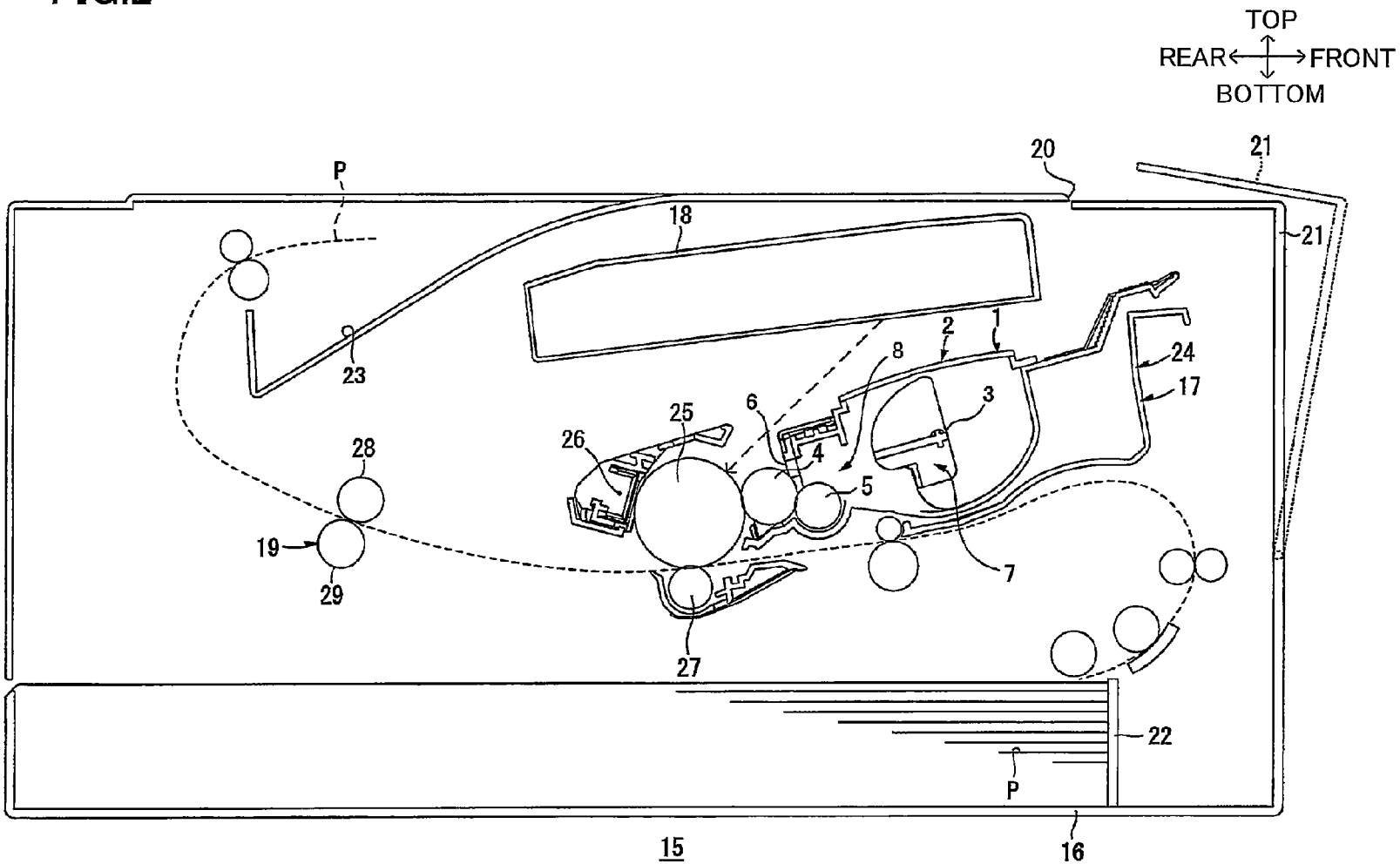
FIG. 2 is a central cross-sectional view of an image forming device in which the developing cartridge shown in FIG. 1 is assembled.

As shown in FIG. 2, a printer 15 is an electrophotographic type monochromatic printer, and includes a main casing 16, a process cartridge 17, a scanner unit 18 and a fixing unit 19.

The main casing 16 is generally box-shaped and includes a front cover 21, a sheet supply tray 22, and a discharge tray 23. The main casing 16 has a front wall formed with an opening 20 for allowing the process cartridge 17 to pass therethrough.

The front cover 21 is plate shaped and generally L-shaped in side view. The front cover 21 has a lower end portion pivotally movably connected to the front wall for opening and closing the opening 20.

The sheet supply tray 22 is positioned at a bottom portion of the main casing 16, and is configured to accommodate a stack of sheets P. The discharge tray 23 is provided at an upper surface of the main casing 16.

The process cartridge 17 is configured to be attached to and detached from the main casing 16 through the opening 20, and includes a drum cartridge 24 and the developing cartridge 1.

The drum cartridge 24 includes a photosensitive drum 25, a scorotron charger 26, and a transfer roller 27. The photosensitive drum 25 is generally cylindrical, and positioned at a rear end portion of a frame of the drum cartridge 24, and extends in the leftward/rightward direction. The photosensitive drum 25 is rotatably supported to the frame of the drum cartridge 24. The scorotron charger 26 is positioned rearward of and spaced away from the photosensitive drum 25. The transfer roller 27 is positioned below the photosensitive drum 25, and in contact with a lower portion thereof.

The developing cartridge 1 is configured to be attached to and detached from the frame of the drum cartridge 24. A rear end portion of the developing roller 4 is in contact with a front end portion of the photosensitive drum 25 when the developing cartridge 1 is attached to the frame of the drum cartridge 24.

The scanner unit 18 is positioned above the process cartridge 17, and is adapted to emit laser beam on the basis of image data to the photosensitive drum 25 as indicated by a broken line shown in FIG. 2.

The fixing unit 19 is positioned rearward of the process cartridge 17, and includes a heat roller 28 and a pressure roller 29 positioned diagonally below and rearward of the heat roller 28. The pressure roller 29 is in pressure contact with a rear lower portion of the heat roller 28.

In operation, upon start of an image forming operation controlled by a controller (not shown), the scorotron charger 26 uniformly charges a surface of the photosensitive drum 25. Then, the scanner unit 18 exposes the photosensitive drum 25 to light, so that an electrostatic latent image based on the image data is formed on the surface of the photosensitive drum 25.

The supply roller 5 supplies toner in the cartridge frame 2 to the developing roller 4, such that the toner triboelectrically charged with positive polarity between the developing roller 4 and the supply roller 5 is carried on the developing roller 4. The blade 6 regulates a thickness of a toner layer carried on the developing roller 4 into a uniform thickness.

The developing roller 4 supplies the toner to the electrostatic latent image formed on the surface of the photosensitive drum 25, so that a visible toner image corresponding to the latent image is carried on the surface of the photosensitive drum 25.

Each one of the sheets P is supplied at a prescribed timing to a portion between the photosensitive drum 25 and the transfer roller 27 by the rotation of conveyer rollers. Thus, the toner image carried on the photosensitive drum 25 is transferred onto the sheet P when the sheet P is moved past the portion between the photosensitive drum 25 and the transfer roller 27.

Then, the sheet P carrying the toner image is heated and compressed when the sheet P is moved past a portion between the heat roller 28 and the pressure roller 29. Thus, the toner image can be thermally fixed to the sheet P. The sheet P is then discharged onto the discharge tray 23.

3. Details of Developing Cartridge (1) Cartridge Frame

Figure 3:
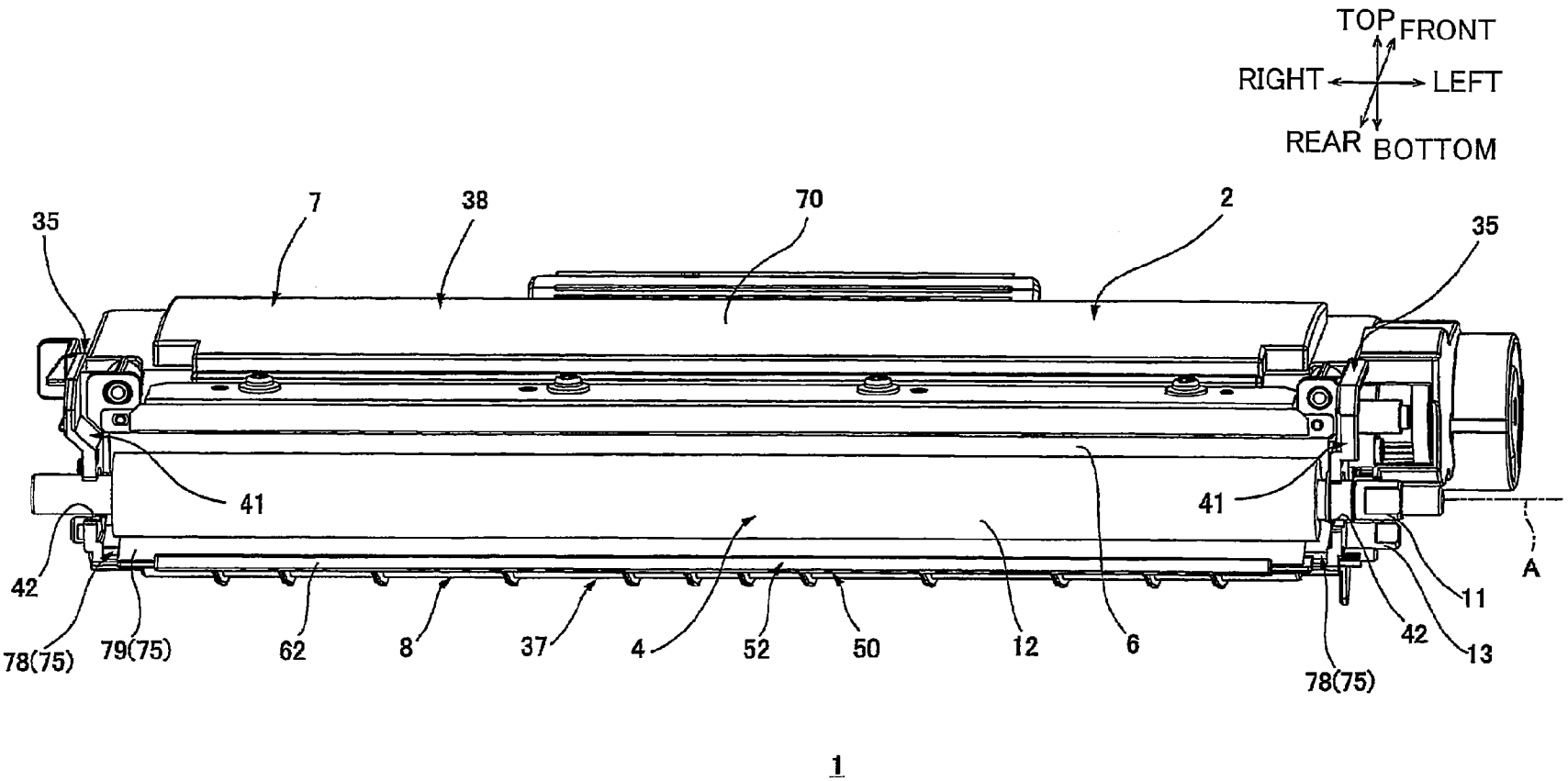
FIG. 3 is a perspective view of the developing cartridge shown in FIG. 1 as viewed from a left rear side thereof.

The developing cartridge 1 includes the cartridge frame 2 shown in FIGS. 1 and 3 as described above. The cartridge frame 2 includes a pair of side walls 35, a lower wall 37, a front wall 36, and an upper wall 38.

The side walls 35 are positioned at left end and right end portions of the cartridge frame 2, respectively, and spaced away from each other as shown in FIG. 3. As shown in FIG. 1, each side wall 35 has a toner chamber wall portion 40 and a developing chamber wall portion 41 integrally therewith. The toner chamber wall portion 40 is located at a front portion of the side wall 35 and extends in frontward/rearward direction, and is generally rectangular plate shaped.

Figures 4A, 4B:
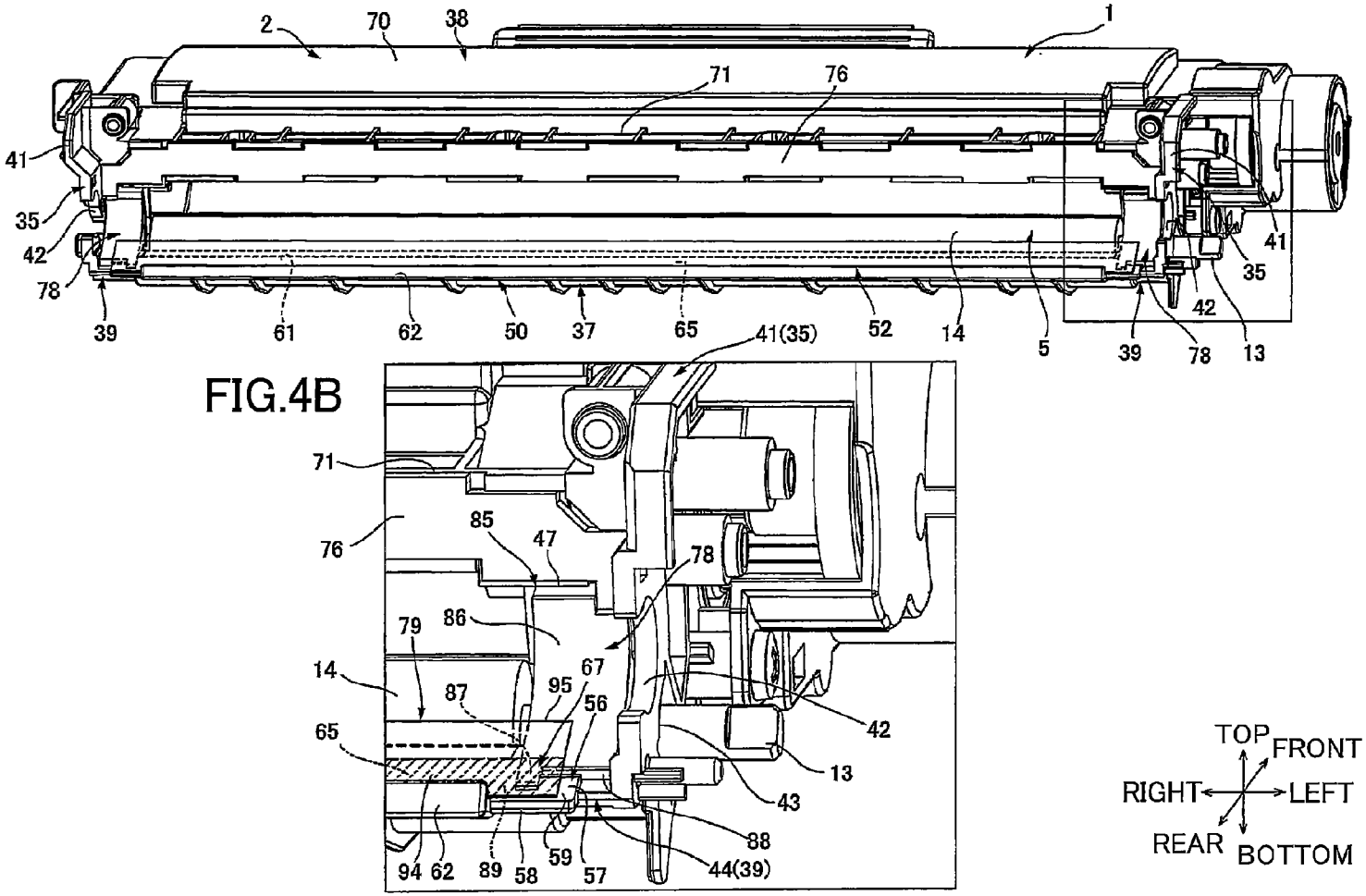
FIG. 4A is a perspective view of the developing cartridge shown in FIG. 1 as viewed from a left rear side thereof, and showing a state where a developing roller is removed from a developing frame.
FIG. 4B is an enlarged perspective view of a portion bounded by a quadrangle of FIG. 4A and particularly showing a side seal and a left end portion of a lower film.

The developing chamber wall portion 41 is located at a rear portion of the side wall 35, and extends rearward from a rear end portion of the toner chamber wall portion 40. The developing chamber wall portion 41 is generally rectangular plate shaped. As shown in FIG. 4B, the developing chamber wall portion 41 is formed with a groove 42 for receiving the shaft 11 of the developing roller 4 and a through-hole 43 for allowing the supply roller shaft 13 of the supply roller 5 to pass therethrough.

The groove 42 is formed at a rear end portion of the developing chamber wall portion 41, and is generally C-shaped in a side view opening rearward. The groove 42 is positioned at generally a center portion of the rear end portion of the developing chamber wall portion 41 in the vertical direction, and is recessed frontward. The groove 42 has an inner diameter that is greater than an outer diameter of the shaft 11 of the developing roller 4.

The through-hole 43 is positioned diagonally front and downward of the groove 42, and has a generally rectangular shaped in side view. The through-hole 43 is formed throughout a thickness of the developing chamber wall portion 41. The through-hole 43 has an inside dimension greater than an outer diameter of the supply roller shaft 13 of the supply roller 5.

As shown in FIG. 1, the lower wall 37 is positioned at a lower end portion of the cartridge frame 2, and includes a curved wall portion 48 and a semi-circular wall portion 49 integrally therewith. The curved wall portion 48 is arcuate and its central portion in the frontward/rearward direction is bent downward. The curved wall portion 48 extends in the leftward/rightward direction and its distal end is connected to and flush with each lower end portion of each toner chamber wall portion 40 of each side wall 35.

Figure 5B:
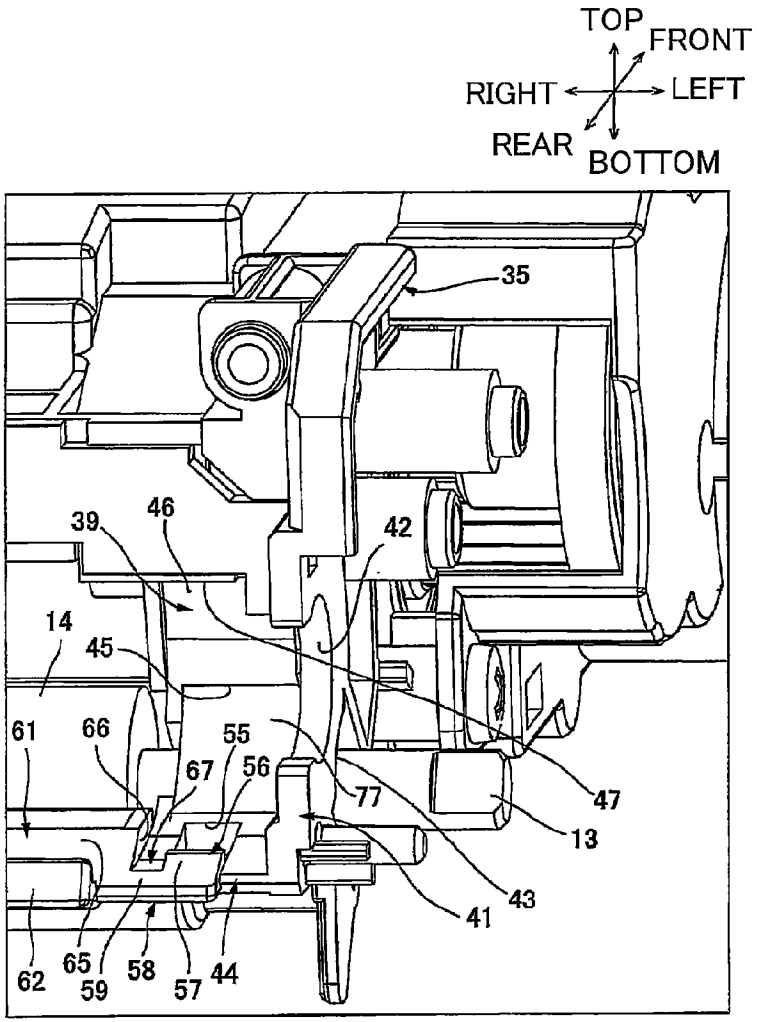
FIG. 5B is an enlarged perspective view of a seal placement portion as viewed from a left rear side thereof and showing a state where the side seal is removed.

The semi-circular wall portion 49 is positioned rearward of the curved wall portion 48, and is semi-circular shaped in side view opening upward. The semi-circular wall portion 49 has an inner peripheral surface whose contour is in conformance with an outer peripheral surface of the supply roller 5. The semi-circular wall portion 49 has a front end portion connected to a rear end portion of the curved wall portion 48. The semi-circular wall portion 49 extends in the leftward/rightward direction and its each distal end is connected to and flush with each inner end portion in the leftward/rightward direction of each seal receiving portion 45 (FIG. 5B, described later).

The front wall 36 is located at the front end portion of the cartridge frame 2, and is generally rectangular plate shaped in front view. The front wall 36 is continuous with a front end portion of the curved wall portion 48 and extends upward therefrom. The front wall 36 has end portions in the leftward/rightward direction, each end portion being connected to and flush with the front end portion of the toner chamber wall portion 40 of the side wall 35.

The upper wall 38 is located at the upper end portion of the cartridge frame 2, and includes a cover portion 70 and a blade seal support portion 71. The cover portion 70 is located at a front end portion of the upper wall 38 and is generally rectangular shaped in plan view. The cover portion 70 extends rearward from an upper end portion of the front wall 36, and also extends in the leftward/rightward direction having each distal end connected to and flush with each upper end portion of each toner chamber wall portion 40 of each side wall 35.

The blade seal support portion 71 is located at a rear end portion of the upper wall 38, and is positioned rearward of the cover portion 70. The blade seal support portion 71 is elongated plate shaped extending in the leftward/rightward direction and has a front end portion connected to a rear end portion of the cover portion 70. Further, each end portion of the blade seal support portion 71 in the leftward/rightward direction is connected to each upper end portion of each developing chamber wall portion 41 of each side wall 35.

Figure 6A:
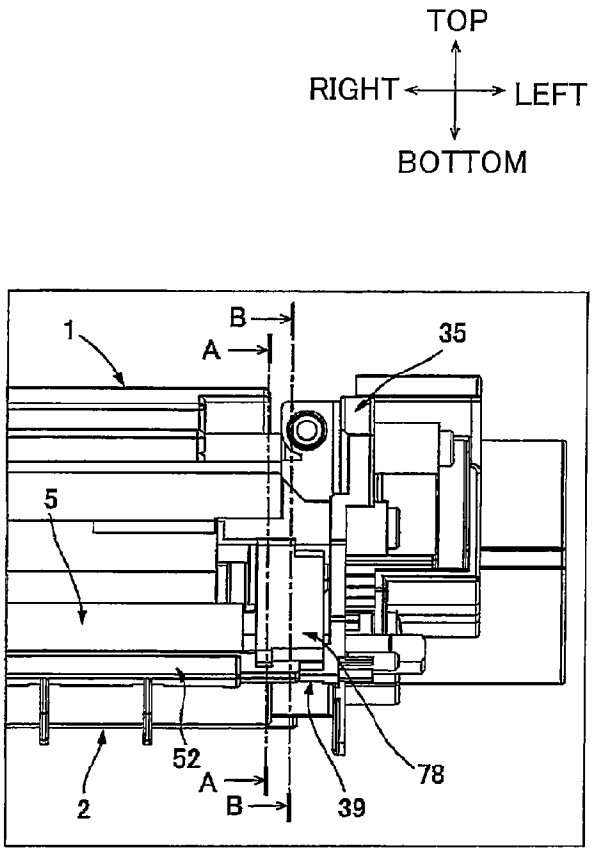
FIG. 6A is a rear view of a left end portion of the developing cartridge shown in FIG. 3.
Figure 6B:
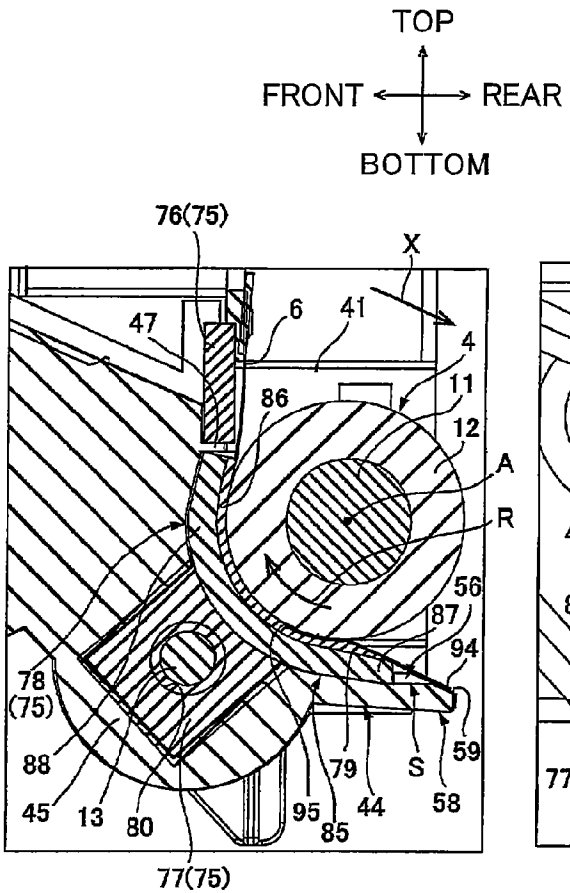
FIG. 6B is a cross-sectional view taken along the line A-A of FIG. 6A.
Figure 6C:
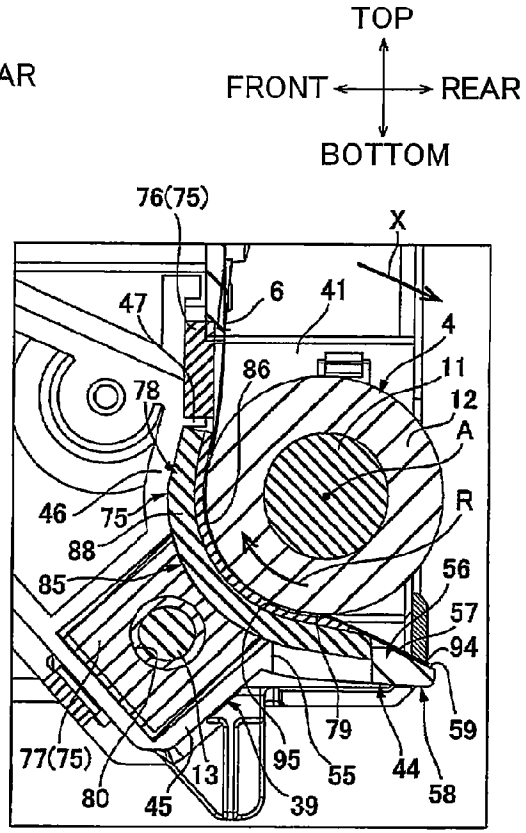
FIG. 6C is a cross-sectional view taken along the line B-B of FIG. 6A.

As shown in FIGS. 1 and 4A, the cartridge frame 2 also includes a seal placement portion 39 as an example of a placement portion, and an adhering portion 52 provided integrally therewith. The seal placement portion 39 is provided at each end portion in the leftward/rightward direction of the roller body 12 of the developing roller 4. Further, each seal placement portion 39 is positioned inward of the developing chamber wall portion 41 in the leftward/rightward direction. As shown in FIG. 6C, the seal placement portion 39 includes the seal receiving portion 45, a first support portion 46, and a second support portion 44.

The seal receiving portion 45 is generally U-shaped in side view opening diagonally upward and rearward, and protrudes inward in the leftward/rightward direction from a portion surrounding the through-hole 43. An innermost end of the seal receiving portion 45 in the leftward/rightward direction is connected to an end portion of the semi-circular wall portion 49 in the leftward/rightward direction.

The first support portion 46 extends upward from an upper end portion of a front wall of the seal receiving portion 45. As shown in FIG. 5B, the first support portion 46 extends in the leftward/rightward direction and has its distal ends each being connected to each inner surface in the leftward/rightward direction of the developing chamber wall portion 41. As shown in FIG. 6C, a rib 47 protrudes rearward from an upper rear surface of the first support portion 46. The rib 47 extends in the leftward/rightward direction.

The second support portion 44 extends rearward from an upper end portion of a rear wall of the seal receiving portion 45. As shown in FIG. 5B, the second support portion 44 extends in the leftward/rightward direction and its distal end portion is connected to an inner surface in the leftward/rightward direction of the developing chamber wall portion 41. The second support portion 44 is formed with a hole 55 positioned at a center portion thereof in plan view and generally rectangular shaped in plan view extending in frontward/rearward direction. As shown in FIG. 6C, the hole 55 extends throughout a thickness of the second support portion 44.

As shown in FIGS. 4A and 4B, the adhering portion 52 includes a lip portion 50, a pair of extension portions 58 and a pair of protrusions 56. As shown in FIG. 1, the lip portion 50 is positioned rearward of the semi-circular wall portion 49, and includes a base portion 61 and a hook portion 62 integral therewith. The base portion 61 extends diagonally downward and rearward from a rear end portion of the semi-circular wall portion 49. As shown in FIG. 4B, the base portion 61 has a rear end portion positioned rearward of a rear end portion of the second support portion 44.

Further, the base portion 61 extends in the leftward/rightward direction, and its each distal end is connected to and flush with each inner end in the leftward/rightward direction of the second support portion 44 as shown in FIG. 5B. Further, the base portion 61 has a vertical dimension greater than that of the second support portion 44. Therefore, an upper surface of the base portion 61 is positioned higher than an upper surface of the second support portion 44.

Thus, a regulation surface 66 as an example of a stepped portion is provided between the upper surface of the base portion 61 and the upper surface of the second support portion 44. The regulation surface 66 is an end face in the leftward/rightward direction of the base portion 61, so that an outer edge in the leftward/rightward direction of the upper surface of the base portion 61 is connected to the upper surface of the second support portion 44 through the regulation surface 66.

As shown in FIG. 1, the base portion 61 has a lip adhering surface 65 as an example of a first surface. The lip adhering surface 65 is located at an upper rear end portion of the base portion 61, and is inclined diagonally downward and rearward in side view. That is, the lip adhering surface 65 is continuous with a rear edge of the regulation surface 66 as shown in FIG. 5B. The lip adhering surface 65 is positioned inward of a side seal 78 (described later) in the leftward/rightward direction.

As shown in FIG. 1, the hook portion 62 is generally L-shaped in side view, and extends rearward from a rear end portion of the base portion 61, and is then bent upward.

As shown in FIG. 5B, each extension portion 58 is positioned outward in the leftward/rightward direction of the rear end portion of the base portion 61, and is positioned rearward of the associated second support portion 44, so that the pair of extension portions 58 interpose therebetween the base portion 61 in the leftward/rightward direction.

Each extension portion 58 is plate-shaped elongated in the leftward/rightward direction. An inner end portion in the leftward/rightward direction of the extension portion 58 is connected to an end portion in the leftward/rightward direction of the rear end portion of the base portion 61. Further, a front end portion of the extension portion 58 is connected to an inner end in the leftward/rightward direction of the rear end portion of the second support portion 44. That is, as shown in FIG. 6B, the extension portion 58 protrudes rearward from the rear end portion of the second support portion 44.

The extension portion 58 has an upper surface at which an extension portion adhering surface 59 as an example of a third surface is defined. The extension portion adhering surface 59 is inclined diagonally downward and rearward, and is continuous with an upper surface of the second support portion 44 corresponding to a recessed portion 67 described later. That is, the extension portion adhering surface 59 extends diagonally downward and rearward from the rear end portion of the upper surface of the second support portion 44. Further, the extension portion adhering surface 59 is continuous with and flush with the lip adhering surface 65 in the leftward/rightward direction.

The protrusion 56 is provided on an upper surface of the second support portion 44 at a position rearward of the hole 55, and is positioned frontward of the extension portion 58.

As shown in FIG. 6C, the protrusion 56 is generally trapezoidal in side view, and protrudes upward from the upper surface of the second support portion 44. Further, the protrusion 56 has a protrusion adhering surface 57 as an example of a second surface. The protrusion adhering surface 57 is a rear surface of the protrusion 56 and is inclined diagonally downward rearward. Further, the protrusion adhering surface 57 and the extension portion adhering surface 59 are continuous with and flush with each other in the leftward/rightward direction as shown in FIG. 5B. That is, flushing surface relationship is provided among the lip adhering surface 65, the protrusion adhering surface 57 and the extension portion adhering surface 59, and these are located on an imaginary identical plane.

The protrusion 56 is positioned outward of in the leftward/rightward direction and spaced away from a rear portion of the regulation surface 66. Thus, the above-mentioned recessed portion 67 is defined by the rear end portion of the regulation surface 66, inner surface in the leftward/rightward direction of the protrusion 56, and the upper surface of the second support portion 44 positioned therebetween. The recessed portion 67 is an example of a grooved portion. The recessed portion 67 constitutes a part of the regulation surface 66.

The recessed portion 67 is U-shaped in back view opening upward. The recessed portion 67 has the rear portion of the regulation surface 66, and is recessed downward such that a bottom end of the recessed portion 67 is positioned farther from the developing roller 4 than the lip adhering surface 65 and the protrusion adhering surface 57 from the developing roller 4.

Further, the recessed portion 67 is surrounded by the lip adhering surface 65, the protrusion adhering surface 57, and the extension portion adhering surface 59 in plan view. In other words, the lip adhering surface 65 and the protrusion adhering surface 57 are spaced away from each other in the leftward/rightward direction, and the extension portion adhering surface 59 is positioned downstream of the protrusion adhering surface 57 and the recessed portion 67 in a first direction X shown in FIG. 6C and described later.

(2) Toner Chamber

A toner chamber 7 is defined at a front portion of the cartridge frame 2 as shown in FIG. 1, and a developing chamber 8 is defined at the rear portion thereof. The toner chamber 7 and the developing chamber 8 are communicated with each other in frontward/rearward direction.

The toner chamber 7 is generally box shaped open rearward, and includes the pair of toner chamber wall portions 40, the curved wall portion 48, the front wall 36 and the cover portion 70. The toner chamber 7 is adapted to accommodate therein positively chargeable non-magnetic single component type polymerized toner. Further, an agitator 3 is provided in the toner chamber 7.

The agitator 3 is positioned at a center portion of the toner chamber 7 in side view, and includes an agitator shaft 9 and agitation blade 10. The agitator shaft 9 is generally cylindrical and extends in the leftward/rightward direction. The agitation blade 10 extends radially outward from the agitator shaft 9. The agitator 3 is supported to the cartridge frame 2 such that each axial end portion of the agitator shaft 9 is rotatably supported to each toner chamber wall portion 40.

(3) Developing Chamber

The developing chamber 8 is defined by the pair of developing chamber wall portion 41, the semi-circular wall portion 49, the lip portion 50, and the blade seal support portion 71. The developing chamber 8 is provided with the developing roller 4, the supply roller 5, the blade 6, and a seal unit 75.

The developing roller 4 is positioned at a rear end portion of the developing chamber 8 and above the lip portion 50. As shown in FIGS. 1 and 3, the developing roller 4 includes the shaft 11 and the developing roller body 12. The shaft 11 is made from metal and generally cylindrical extending in the leftward/rightward direction. Each left and right end portion of the shaft 11 is inserted through the groove 42 formed in the developing chamber wall portion 41.

The developing roller body 12 is generally cylindrical and extends in the leftward/rightward direction. The developing roller body 12 is made from an electrically conductive rubber. The developing roller body 12 is formed over the shaft 11 except the left and right end portions thereof. The upper and rear portions of the developing roller body 12 are exposed to an outside of the cartridge frame 2. Further, as shown in FIG. 6C, each of the left and right end portions of the developing roller body 12 is positioned diagonally rearward and upward of the seal placement portion 39. The developing roller 4 is supported to the cartridge frame 2 such that each of the left and right end portions of the shaft 11 is rotatably supported to the developing chamber wall portion 41.

Incidentally, the developing roller 4 is configured to receive a driving force from a drive source such as a motor (not shown) during a developing operation. Further, the developing roller 4 is applied with a developing bias from a power source during a developing operation. Upon application of the driving force to the developing roller 4, the developing roller 4 is rotated about a center axis A of the shaft 11 in a rotating direction R, i.e., clockwise direction in right side view. The center axis A is an example of a first axis. The drive source and power source are provided in the main casing 16.

As shown in FIG. 1, the supply roller 5 is positioned on the semi-circular wall portion 49, and includes the supply roller shaft 13 and the supply roller body 14. The supply roller shaft 13 is made from metal and generally cylindrical extending in the leftward/rightward direction. Each left and right end portion of the supply roller shaft 13 is inserted through the through-hole 43 formed in the developing chamber wall portion 41 as shown in FIG. 5B.

The supply roller body 14 is generally cylindrical extending in the leftward/rightward direction, and made from an electrically conductive sponge. The supply roller body 14 is formed over the supply roller shaft 13 except the left and right end portions thereof. The upper rear portion of the supply roller body 14 is in contact with the lower front portion of the developing roller body 12. The supply roller 5 is supported to the cartridge frame 2 such that each of the left and right end portions of the supply roller shaft 13 is rotatably supported to the developing chamber wall portion 41.

Incidentally, the supply roller 5 is configured to receive a driving force from the drive source such as the motor (not shown) during a developing operation. Further, the supply roller 5 is applied with a supply bias from the power source during a developing operation. Upon application of a driving force to the supply roller 5, the supply roller 5 is rotated in a rotating direction opposite to the rotating direction of the developing roller 4, i.e., counterclockwise direction in a left side view in FIG. 1 at a portion contacting the developing roller 4.

As shown in FIG. 1, the blade 6 is positioned rearward of the blade seal support portion 71, and is elongated rectangular shaped extending in the leftward/rightward direction as shown in FIG. 3. The blade 6 is made from a thin metal plate resiliently deformable. The blade 6 is fixed to the blade seal support portion 71 such that a lower end of the blade 6 is in contact with a front end portion of the developing roller body 12 as shown in FIG. 1 over the length of the blade 6.

The seal unit 75 includes a blade seal 76, a supply seal 77, the side seal 78 as an example of a first seal and a lower film 79 as an example of a second seal as shown in FIGS. 1, 4A, and 6B. The blade seal 76 is interposed between a front surface of the blade 6 and a rear surface of the blade seal support portion 71 as shown in FIG. 1. The blade seal 76 is made from a resiliently deformable material such as a sponge. The blade seal 76 is elongate plate shaped extending in the leftward/rightward direction as shown in FIG. 4A.

The supply seal 77 is provided at each axial end portion of the supply roller shaft 13, and is accommodated in the seal receiving portion 45 as shown in FIG. 6C. The supply seal 77 is made from a resiliently deformable material such as a sponge, and is generally rectangular shaped in side view extending in the leftward/rightward direction.

The supply seal 77 is formed with a shaft insertion hole 80 at a central portion thereof in side view. The shaft insertion hole 80 extends throughout the supply seal 77 in the leftward/rightward direction. Each of the left and right end portions of the supply roller shaft 13 is rotatably received in each shaft insertion hole 80. Thus, each supply seal 77 is positioned outward in the leftward/rightward direction of each end face of the supply roller body 14.

The supply seal 77 has a rear surface formed into an arcuate shape in side view, in conformance with a curvature of the peripheral surface of the developing roller body 12. The rear surface of the supply seal 77 is continuous with a rear surface of the first support portion 46 and an upper surface of the second support portion 44 as shown in FIG. 6C.

As shown in FIG. 4A each side seal 78 is provided at each seal placement portion 39. As shown in FIG. 6C, the side seal 78 is provided between the seal placement portion 39 and the peripheral surface of the axial end portion of the developing roller body 12.

The side seal 78 includes a base portion 85 and a contact portion 86. The base portion 85 is made from a resiliently deformable material such as a sponge and an elastomer, for example, silicone rubber and natural rubber. The base portion 85 includes a main seal portion 88 and a projecting portion 87.

Figure 7:
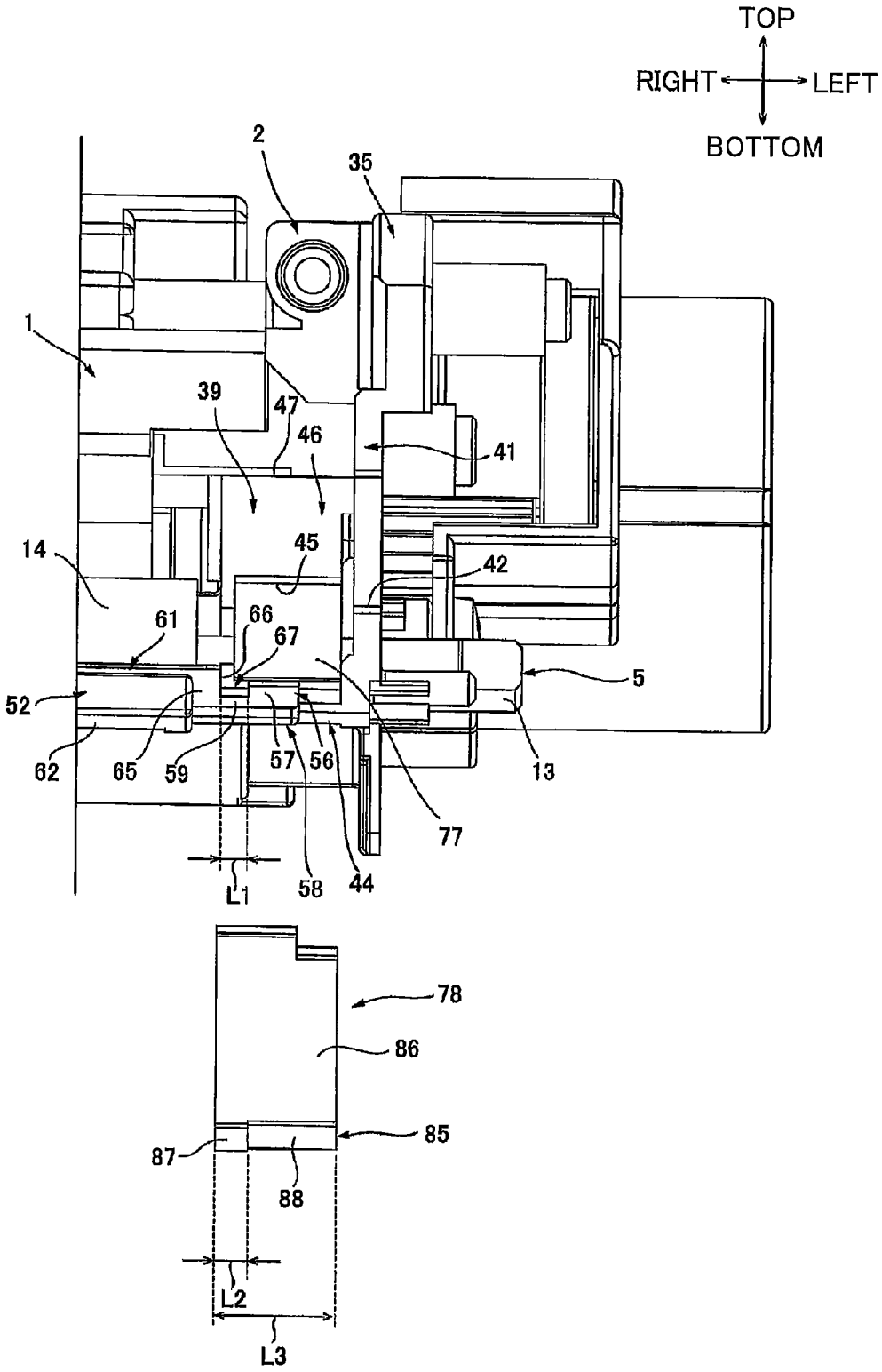
FIG. 7 is a view for description of assembly of the side seal with respect to the seal placement portion shown in FIG. 5B.

The main seal portion 88 is generally prismatic body shaped extending in a vertical direction as shown in FIG. 7. The projecting portion 87 is located at a lower end portion of the main seal portion 88. The projecting portion 87 is generally prismatic body shaped and protruding downward from an inner end portion in the leftward/rightward direction of a lower surface of the main seal portion 88.

The projecting portion 87 has a dimension L2 in the leftward/rightward direction less than or equal to half the length of a dimension L3 in the leftward/rightward direction of the main seal portion 88 in a state prior to the placement of the side seal 78 on the seal placement portion 39, and more specifically, the dimension L2 is approximately one fourth of the dimension L3. Further, the dimension L2 is more than or equal to a dimension L1 in the leftward/rightward direction of the recessed portion 67, i.e., L1 is a distance between the regulation surface 66 and the inner surface in the leftward/rightward direction of the protrusion 56 in a state prior to the placement of the side seal 78 on the seal placement portion 39, and more specifically, L2 is greater than L1.

The contact portion 86 is positioned adjacent to and rearward of the main seal portion 88. The contact portion 86 is made of a fabric material or felt material of, for example, cashmere fiber, polytetrafluoroethylene (PTFE) fiber, and polyester fiber. The contact portion 86 has a shape and dimension identical to those of the main seal portion 88 in rear view, and is adhesively bonded to a rear surface of the main seal portion 88.

Figure 5A:
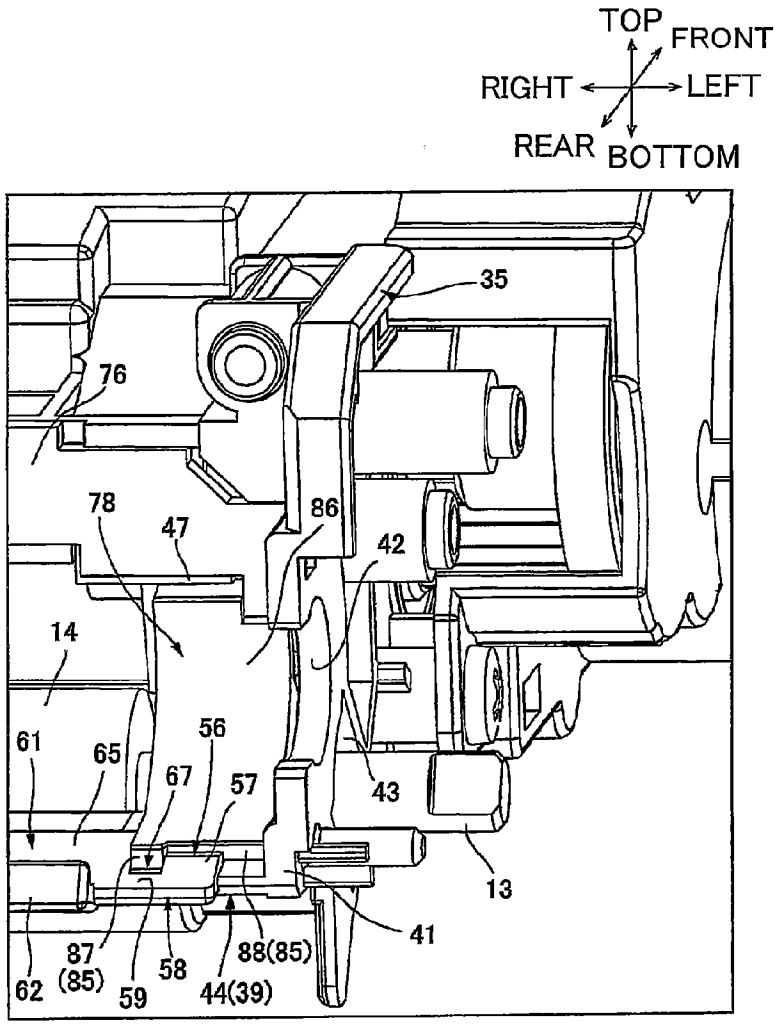
FIG. 5A is an enlarged perspective view of the portion shown in FIG. 4B as viewed from a left rear side thereof and showing a state where the lower film is removed.

As shown in FIG. 6C, the side seal 78 is curved into C-shape opening rearward and upward, and is placed on the seal placement portion 39. As shown in FIG. 5A, a center portion in the leftward/rightward direction of an upstream end in the rotational direction R of the main seal portion 88 is in contact with a front end surface of the protrusion 56 in a state where the side seal 78 is positioned on the seal placement portion 39. With this structure, the protrusion 56 prevents the side seal 78 from moving in a direction opposite to the rotational direction R.

The main seal portion 88 has a downstream end in the rotational direction R in contact with the lower surface of the rib 47. With this structure, the rib 47 prevents the side seal 78 from moving in the rotational direction R. Consequently, the protrusion 56 and the rib 47 provide positioning of the side seal 78 in the rotational direction R.

Further, as shown in FIGS. 5A and 6B, the projecting portion 87 is positioned in the recessed portion 67. Therefore, in plan view, the base portion 61 is positioned immediate rightward of the projecting portion 87, the protrusion 56 is positioned immediate leftward of the projecting portion 87, and the extension portion 58 is positioned rearward of the projecting portion 87, that is upstream of the projecting portion 87 in the rotational direction R. Further, the projecting portion 87 is positioned at the most upstream position of the side seal 78 in the rotational direction R. The projecting portion 87 is positioned upstream of the main seal portion 88 and protrudes toward and upstream in the rotational direction R from the main seal portion 88.

The lower film 79 is positioned on an upper surface of the lip portion 50 as shown in FIG. 1. The lower film 79 is made from a resin sheet such as polyethylene terephthalate, and is rectangular shaped extending in the leftward/rightward direction in plan view.

As shown in FIG. 4B, the lower film 79 has an adhesive layer 89 such as a double-stick tape. The adhesive layer 89 is positioned at a lower surface of a rear end portion 94 of the lower film 79 and extends over a length of the lower film 79 in the leftward/rightward direction. The rear end portion 94 is an example of a first end portion.

As shown in FIGS. 4A and 4B, the lower film 79 is supported by the cartridge frame 2 in such a manner that the adhesive layer 89 is collectively adhered on the upper surfaces of the lip adhering surface 65, the extension portion adhering surface 59, the protrusion adhering surface 57, and the projecting portion 87. That is, the rear end portion 94 of the lower film 79 is adhered to the adhering portion 52 through the adhesive layer 89, more specifically to the lip adhering surface 65, the extension portion adhering surface 59, and the protrusion adhering surface 57. Thus, the lip adhering surface 65, the extension portion adhering surface 59, and the protrusion adhering surface 57 function as an adhesion surface.

As shown in FIG. 6C, the lower film 79 has a front end portion 95 in contact with a lower peripheral end portion of the developing roller body 12 along a length thereof in the leftward/rightward direction. The front end portion 95 is an example of a second end portion. In side view, the lower film 79 extends from the front end portion 95 to the rear end portion 94 in a first direction X directed diagonally downward and rearward from the front end portion 95.

Further, each of left and right end regions of the front end portion 95 of the lower film 79 is nipped between an upstream end portion in the rotational direction R of the contact portion 86 of the side seal 78 and a peripheral surface of the developing roller body 12. In other words, the end region of the lower film 79 is positioned between the side seal 78 and the peripheral surface at the end portion of the developing roller 4.

Further, as shown in FIG. 6B, a space S is defined at an upstream end portion of the projecting portion 87 in the rotational direction by an upstream end surface of the projecting portion 87 in the rotational direction R, the recessed portion 67, and a lower surface of the rear end portion 94 of the lower film 79. More specifically, the space S is defined by the upstream end surface of the projecting portion 87, inner surface in the leftward/rightward direction of the protrusion 56, the regulation surface 66, the upper surface of the second support portion 44, and the lower surface of the rear end portion 94 of the lower film 79.

(4) Attachment of Side Seal and Lower Film to the Cartridge Frame

The side seal 78 and the lower film 79 are attached to the cartridge frame 2 in the following manner:

First, as shown in FIG. 7, the side seal 78 is attached to the seal placement portion 39. To this effect, the side seal 78 is initially positioned rearward of the seal placement portion 39, and then gradually approaches the seal placement portion 39.

In this case, as shown in FIG. 6C, the side seal 78 is resiliently deformed into C-shape in side view such that the upper end of the main seal portion 88 is in contact with the lower surface of the rib 47, and the lower end of the main seal portion 88 is in contact with the front surface of the protrusion 56.

Further, since the dimension L2 in the leftward/rightward direction of the projecting portion 87 is greater than the dimension L1 in the leftward/rightward direction of the recessed portion 67, the projecting portion 87 is forced into the recessed portion 67 in a compressed manner in the leftward/rightward direction. Therefore, the projecting portion 87 is nipped between the regulation surface 66 and the inner surface in the leftward/rightward direction of the protrusion 56, and is compressed in the leftward/rightward direction.

In this case, the protrusion 56 is positioned immediate leftward of the projecting portion 87, and immediate upstream in the rotational direction R of the main seal portion 88. Further, the base portion 61 is positioned opposite to the protrusion 56 with respect to the projecting portion 87, and is positioned rightward of the projecting portion 87. As a result, attachment of the side seal 78 to the seal placement portion 39 is completed. In a state where the side seal 78 is attached to the seal placement portion 39, the front surface of the main seal portion 88 (the front surface being the surface facing the seal placement portion 39) is in direct contact with the rear surface of the first support portion 46, the rear surface of the supply seal 77, and the upper surface with the second support portion 44 as shown in FIG. 6C.

Then, as shown in FIGS. 4A and 4B, the lower film 79 is attached to the lip portion 50 from above, so that the center portion in the leftward/rightward direction of the adhesive layer 89 of the lower film 79 is adhered to the lip adhering surface 65, and left and right end portions of the adhesive layer 89 are adhered to the extension portion adhering surface 59, the protrusion adhering surface 57 and the upper surface of the projecting portion 87.

Thus, as shown in FIG. 6B, the projecting portion 87 is positioned between the end portion in the leftward/rightward direction of the rear end portion 94 of the lower film 79 and a bottom surface of the recessed portion 67. Further, the projecting portion 87 is compressed from the above by the lower film 79. Accordingly, the projecting portion 87 is in close contact with the regulation surface 66 (FIG. 5B), the inner surface in the leftward/rightward direction of the protrusion 56 and the upper surface of the second support portion 44 as shown in FIG. 4B. With this structure, attachment of the lower film 79 to the lip portion 50 is completed.

Next, the developing roller 4 is assembled to the developing chamber 8 of the cartridge frame 2. By this assembly, the lower peripheral end portion of the developing roller body 12 is in contact with the front end portion 95 of the lower film 79 throughout the length of the developing roller body 12 in the leftward/rightward direction as shown in FIG. 1.

Further, each end portion in the leftward/rightward direction of the developing roller body 12 is positioned diagonally upward and rearward of the side seal 78 such that the side seal 78 is interposed between the end portion of the developing roller body 12 and the seal placement portion 39. Further, each end portion in the leftward/rightward direction of the front end portion 95 of the lower film 79 is interposed between the upstream end portion in the rotational direction R of the contact portion 86 of the side seal 78 and the peripheral surface at the end portion in the leftward/rightward direction of the developing roller body 12.

Here, the upstream end portion in rotational direction R of the side seal 78 is nipped and compressed in the vertical direction between the end portion in the leftward/rightward direction of the developing roller body 12 and the second support portion 44. Accordingly, the upstream end portion in rotational direction R of the main seal portion 88 is bulged downward into the hole 55. As a result, resilient force of the main seal portion 88 is lowered. Consequently, excessive compression to the end portion in the leftward/rightward direction of the front end portion 95 of the lower film 79 against the peripheral surface of the developing roller body 12 due to the resilient force of the main seal portion 88 can be restrained. As a result, frictional wearing of the developing roller body 12 and the end portion in the leftward/rightward direction of the front end portion 95 of the lower film 79 can be restrained.

(5) Developing Operation

The developing cartridge 1 performs a developing operation as follows. The developing roller 4, the supply roller 5 and the agitator 3 are rotated upon receiving driving force from the drive source (not shown) as shown in FIG. 1. The agitation blade 10 conveys the toner in the toner chamber 7 toward the developing chamber 8 by the rotation of the agitator 3, so that the toner is supplied from the toner chamber 7 to the developing chamber 8.

The toner supplied to the developing chamber 8 is then supplied to the supply roller body 14 of the supply roller 5, so that the toner is supplied from the supply roller body 14 to the developing roller body 12 of the developing roller 4 by the rotation of the supply roller 5. In this case, triboelectric charging occurs for charging the toner with positive polarity. Thus, the developing roller body 12 carries the toner.

Then, the toner layer thickness regulation blade 6 regulates a thickness of the toner layer carried on the surface of the developing roller body 12. In this case, since the contact portion 86 of the side seal 78 is in contact with the peripheral surface of the end portion in the leftward/rightward direction of the developing roller body 12 as shown in FIG. 6C, toner leakage out of the end portion in the leftward/rightward direction of the developing roller 4 can be restrained.

Further, since the projecting portion 87 is compressed in the recessed portion 67 as shown in FIG. 4B, toner leakage out of a boundary between the recessed portion 67 and the projecting portion 87 can be restrained. Further, since the rear end portion 94 of the lower film 79 is adhesively attached to the upper surface of the projecting portion 87, the toner which may be moved along a surface of the side seal 78 can be dammed up by the rear end portion 94 of the lower film 79.

3. Function and Effect (1) As shown in FIG. 5A, the developing cartridge 1 is provided with the lip adhering surface 65 positioned immediately rightward of the side seal 78, and the protrusion adhering surface 57 positioned immediately rearward of the side seal 78 in plan view. Further, as shown in FIG. 4B, each end portion in the leftward/rightward direction of the rear end portion 94 of the lower film 79 is adhered to the lip adhering surface 65 and the protrusion adhering surface 57. With this structure, the side seal 78, in particular the projecting portion 87 positioned immediately beside the lip adhering surface 65 and the protrusion adhering surface 57 is compressed by the rear end portion 94 of the lower film 79 in the seal placement portion 39.

Accordingly, intimate contact between the side seal 78 and the lower film 79 can result, and intimate contact between the projecting portion 87 of the side seal 78 and the regulation surface 66 of the recessed portion 67 can result. Consequently, generation of a gap at the boundary between the side seal 78 and the lower film 79 and at the boundary between the projecting portion 87 and the regulation surface 66 can be restrained. As a result, toner leakage from the boundary between the side seal 78 and the lower film 79 and the boundary between the projecting portion 87 and the regulation surface 66 can be restrained.

At least a part of the rear end portion 94 of the lower film 79 is adhered to the projecting portion 87 of the side seal 78. Therefore, toner leaking along the surface of the side seal 78 can be blocked or dammed up by the rear end portion 94. Consequently, toner leakage through a gap between the side seal 78 and the peripheral surface of the end portion in the leftward/rightward direction of the developing roller 4 can be restrained.

As a result, toner leakage out of the cartridge frame 2 can be restrained even by the high speed operation of the developing roller 4, prolongation of the service life of the developing cartridge 1, and particle size reduction of the toner.

(2) As shown in FIG. 4B, the adhering portion 52 includes the extension portion adhering surface 59. Therefore, sufficient adhesion area for adhesively bonding the rear end portion 94 of the lower film 79 can be provided.

Further, since each end portion in the leftward/rightward direction of the rear end portion 94 of the lower film 79 is adhered to the protrusion adhering surface 57, the extension portion adhering surface 59, and the lip adhering surface 65, the stable compression to the projecting portion 87 by the end portion of the rear end portion 94 of the lower film 79 can be realized, so that stable contact of the projecting portion 87 with the regulation surface 66 of the recessed portion 67 can be realized.

(3) Further, the space S is defined by the upstream end portion in rotational direction R of the projecting portion 87, the recessed portion 67, and the lower surface of the rear end portion 94 of the lower film 79 as shown in FIG. 6B. Therefore, even if toner is entered into the boundary between the projecting portion 87 and the regulation surface 66 in accordance with the rotation of the developing roller 4, the entered toner can be retained in the space S. Thus, toner leakage out of the cartridge frame 2 can be restrained with certainty.

(4) Further, as shown in FIG. 6B, the projecting portion 87 is positioned in the recessed portion 67, so that each projecting portion 87 is compressed by each end portion in the leftward/rightward direction of the rear end portion 94 of the lower film 79. That is, reaction force applied to the end portion in the leftward/rightward direction of the rear end portion 94 of the lower film 79 can be lowered in comparison with a case where the main seal portion 88 is compressed by the end portion of the rear end portion 94. Accordingly, peel off of the rear end portion 94 of the lower film 79 from the protrusion adhering surface 57, the extension portion adhering surface 59, and the lip adhering surface 65 can be avoided or restrained.

(5) Further, as shown in FIG. 7, prior to the placement of the side seal 78 to the seal placement portion 39, the dimension L2 in the leftward/rightward direction of the projecting portion 87 is more than or equal to the dimension L1 in the leftward/rightward direction of the recessed portion 67, L1 being the distance in the leftward/rightward direction between the inner surface in the leftward/rightward direction of the protrusion 56 and the regulation surface 66.

With this structure, stabilized compression to the projecting portion 87 can be provided in a state where the projecting portion 87 is positioned between the inner surface in the leftward/rightward direction of the protrusion 56 and the regulation surface 66, and between the recessed portion 67 and the end portion in the leftward/rightward direction of the rear end portion 94 of the lower film 79. Accordingly, stable contact of the projecting portion 87 with the inner surface of the protrusion 56 and the regulation surface 66 can be provided. Consequently, generation of gap at the boundary between the projecting portion 87 and the inner surface in the leftward/rightward direction of the protrusion 57 and at the boundary between the projecting portion 87 and the regulation surface 66 can be restrained, thereby restraining toner leakage from these boundaries.

(6) Further, as shown in FIG. 7, the dimension L2 in the leftward/rightward direction of the projecting portion 87 is less than or equal to half of the dimension L3 in the leftward/rightward direction of the main seal portion 88, and more specifically, L2 is approximately one-fourth of the dimension L3 prior to attachment of the side seal 78 to the seal placement portion 39.

With this structure, a volume of the base portion 85 to be compressed by the end portion in the leftward/rightward direction of the rear end portion 94 of the lower film 79 can be reduced. Accordingly, reaction force applied to the end portion in the leftward/rightward direction of the rear end portion 94 of the lower film 79 can be reduced, thereby preventing the rear end portion 94 of the lower film 79 from being peeled off from the adhering portion.

(7) Further, the end portion in the leftward/rightward direction of the rear end portion 94 of the lower film 79 is adhered to the protrusion adhering surface 57, and the front surface of the protrusion 56 is in contact with the upstream end portion in rotational direction R of the main seal portion 88 of the side seal 78 as shown in FIG. 6C.

That is, the protrusion 56 is used not only for adhering the end portion of the rear end portion 94 but also for positioning the side seal 78. Accordingly, a compact developing cartridge 1 can be provided in comparison with a case where an adhesive portion to which the rear end portion 94 is adhered and a positioning portion for positioning the side seal 78 are provided independent of each other.

Accordingly, sufficient adhesion area for adhering the rear end portion 94 can be obtained, and a compact developing cartridge 1 can be provided while the positioning of the side seal 78 in rotational direction R is realized.

Further, the side seal 78 is in direct contact with the rear surface of the first support portion 46 and the upper surface of the second support portion 44 as shown in FIGS. 6B and 6C. That is, the side seal 78 is positioned in the seal placement portion 39 without adhesive bonding to the first support portion 46 and the second support portion 44. Therefore, an additional member such as an adhesion tape for adhering the side seal 78 to the seal placement portion 39 can be dispensed with, thereby reducing a-cost. Further, attachment work for attaching the side seal 78 to the seal placement portion 39 can be facilitated because the adhesive tape is not employed.

4. Modification

While the invention has been described in detail with reference to the embodiment thereof, it would be apparent to those skilled in the art that various changes and modifications may be made therein without departing from the spirit of the invention.

For example, a developing cartridge can be integral with a drum cartridge. In the latter case, the integral process cartridge is an example of the developing device.

Further, a toner cartridge can be attached to and detached from a frame supporting the developing roller 4. In other words, the toner cartridge can be detachably attached to a developing cartridge. In the latter case, the effect and function the same as those of the above-described embodiment can be obtained.

Further, the above-described embodiment and the modified embodiment can be suitably combined together.

What is claimed is:

1. A developing device comprising:

a frame configured to accommodate developing agent therein;

a developing roller rotatable in a rotational direction about an axis defining an axial direction relative to the frame, the developing roller having a peripheral surface and an end portion in the axial direction;

a first seal provided between the frame and the peripheral surface at the end portion of the developing roller, the first seal having an upstream end portion in the rotational direction; and a second seal extending in the axial direction and in contact with the peripheral surface, the second seal having an end region in the axial direction, the end region being positioned between the first seal and the peripheral surface at the end portion of the developing roller;

wherein the frame comprises a seal placement portion at which the first seal is positioned, and a seal adhesion surface to which the second seal is adhered, the seal placement portion having a stepped portion connected to the seal adhesion surface and positioned farther from the developing roller than the seal adhesion surface to the developing roller in a direction perpendicular to the axial direction, the seal adhesion surface including a first surface and a second surface, the first surface being connected to the first seal in the axial direction and positioned inward of the first seal in the axial direction, and the second surface being positioned adjacent to and upstream of the upstream end portion of the first seal; and wherein the second seal has a first end portion and a second end portion, the first end portion being adhered to the seal adhesion surface and having an end part in the axial direction adhered onto the first seal, the second end portion being positioned opposite to the first end portion in the rotational direction and in contact with the peripheral surface of the developing roller, the first seal being compressed in the seal placement portion by the second seal to abut on the stepped portion.

2. The developing device as claimed in claim 1, wherein the first surface and the second surface are spaced away from each other in the axial direction;

wherein the seal placement portion has a grooved portion whose bottom is positioned farther from the developing roller than the seal adhesion surface to the developing roller, the grooved portion constituting a part of the stepped portion; and wherein the seal adhesion surface further includes a third surface positioned downstream of the second surface and the grooved portion in the rotational direction.

3. The developing device as claimed in claim 2, wherein the upstream end portion of the first seal, the grooved portion, and the second seal define a space.

4. The developing device as claimed in claim 2, wherein the first seal has a main seal portion and a projecting portion protruding upstream in the rotational direction from the main seal portion and positioned in the grooved portion, the end part of the first end portion being adhered to the projecting portion.

5. The developing device as claimed in claim 4, wherein the projecting portion has a dimension in the axial direction more than or equal to a dimension of the grooved portion in the axial direction prior to placement of the first seal in the seal placement portion.

6. The developing device as claimed in claim 4, wherein the projecting portion has a dimension in the axial direction less than or equal to a half of a dimension of the main seal portion in the axial direction.

7. The developing device as claimed in claim 1, wherein the frame further comprises a protrusion in abutment with the upstream end portion of the first seal for positioning the first seal in the rotational direction, the protrusion providing the second surface.

8. The developing device as claimed in claim 1, wherein the first seal is in direct contact with the frame.

* * * * *